US009222207B2

(12) United States Patent
Weiner et al.

(10) Patent No.: US 9,222,207 B2
(45) Date of Patent: Dec. 29, 2015

(54) CROSS-TUFTING MACHINE AND PROCESS FOR CARPET MANUFACTURING

(71) Applicants: Robert S. Weiner, Atlanta, GA (US); M. Steven Berger, Menlo, GA (US); David B. Porter, Ringgold, GA (US)

(72) Inventors: Robert S. Weiner, Atlanta, GA (US); M. Steven Berger, Menlo, GA (US); David B. Porter, Ringgold, GA (US)

(73) Assignee: SIDETUFT, LLC, Atlanta, GA (US)

( * ) Notice: Subject to any disclaimer, the term of this patent is extended or adjusted under 35 U.S.C. 154(b) by 0 days.

(21) Appl. No.: 14/198,225

(22) Filed: Mar. 5, 2014

(65) Prior Publication Data

US 2014/0272260 A1 Sep. 18, 2014

Related U.S. Application Data

(60) Provisional application No. 61/783,034, filed on Mar. 14, 2013.

(51) Int. Cl.

| | |
|---|---|
| ***D05C 15/30*** | (2006.01) |
| ***D05C 15/34*** | (2006.01) |
| ***D05B 19/14*** | (2006.01) |
| ***D05C 15/36*** | (2006.01) |

(52) U.S. Cl.

CPC ..... *D05C 15/30* (2013.01); *D05B 19/14* (2013.01); *D05C 15/34* (2013.01); *D05C 15/36* (2013.01); *Y10T 428/23929* (2015.04)

(58) Field of Classification Search

CPC ..... D05C 15/00; D05C 15/04; D05C 15/08; D05C 15/10; D05C 15/12; D05C 15/14; D05C 15/18; D05C 15/20; D05C 15/26; D05C 15/28; D05C 15/30; D05C 15/32; D05C 15/34; D05C 15/36; D05B 19/14

See application file for complete search history.

(56) References Cited

U.S. PATENT DOCUMENTS

| | | | | |
|---|---|---|---|---|
| 3,396,687 | A | | 8/1968 | Nowicki |
| 3,972,295 | A | | 8/1976 | Smith |
| 4,366,761 | A | | 1/1983 | Card |
| 4,637,948 | A | * | 1/1987 | Evans et al. ..... 428/89 |
| 4,662,291 | A | | 5/1987 | Bardsley |
| 4,693,190 | A | * | 9/1987 | Slattery ..... 112/80.3 |
| 4,726,306 | A | | 2/1988 | Crumbliss |
| 4,820,566 | A | * | 4/1989 | Heine et al. ..... 428/88 |
| 4,836,118 | A | | 6/1989 | Card et al. |
| 5,193,472 | A | | 3/1993 | Crossley |
| 5,383,415 | A | | 1/1995 | Padgett, III |
| 5,392,723 | A | | 2/1995 | Kaju |
| 5,503,092 | A | * | 4/1996 | Aubourg et al. ..... 112/80.23 |
| 5,560,307 | A | * | 10/1996 | Padgett et al. ..... 112/410 |
| 5,605,107 | A | | 2/1997 | Padgett, III et al. |
| 5,738,030 | A | | 4/1998 | Ok |
| 5,743,200 | A | | 4/1998 | Miller et al. |
| 5,794,551 | A | | 8/1998 | Morrison et al. |
| 6,079,341 | A | | 6/2000 | Resta |
| 6,228,460 | B1 | | 5/2001 | Hamilton et al. |
| 6,263,811 | B1 | | 7/2001 | Crossley |
| 7,218,987 | B2 | | 5/2007 | Mile et al. |

(Continued)

*Primary Examiner* — Ismael Izaguirre

(74) *Attorney, Agent, or Firm* — Gardner Groff Greenwald & Villanueva, PC

(57) ABSTRACT

A cross-tufting machine and process for manufacturing carpet. The cross-tufting machine includes a sewing head and a tufting gun. The sewing head is movably mounted on support railing and a support platform is provided to support carpet that is to be provided with a tufted secondary pattern. The carpet moves in steps on top of the support platform in a machine direction and the sewing head traverses back and forth in a cross-wise direction wherein the tufting gun forms the tufted secondary pattern in the carpet.

41 Claims, 10 Drawing Sheets

(56) References Cited

U.S. PATENT DOCUMENTS

| | | | | |
|---|---|---|---|---|
| 7,634,326 | B2 | 12/2009 | Christman, Jr. et al. | |
| 8,096,247 | B2 | 1/2012 | Monroe et al. | |
| 8,141,505 | B2 | 3/2012 | Hall et al. | |
| 8,225,727 | B2 | 7/2012 | Wilson et al. | |
| 8,240,263 | B1 | 8/2012 | Frost et al. | |
| 8,739,716 | B2 | 6/2014 | Price et al. | |
| 2009/0173262 | A1 * | 7/2009 | Wilson et al. | 112/80.73 |
| 2012/0174846 | A1 | 7/2012 | Hall et al. | |

* cited by examiner

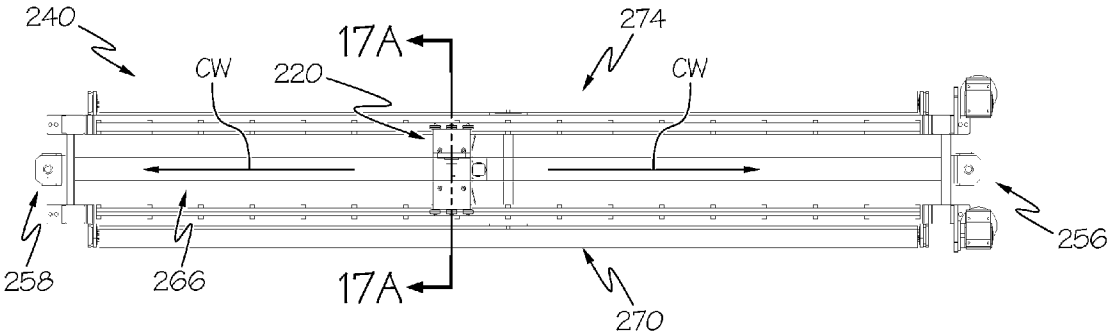
FIG. 17
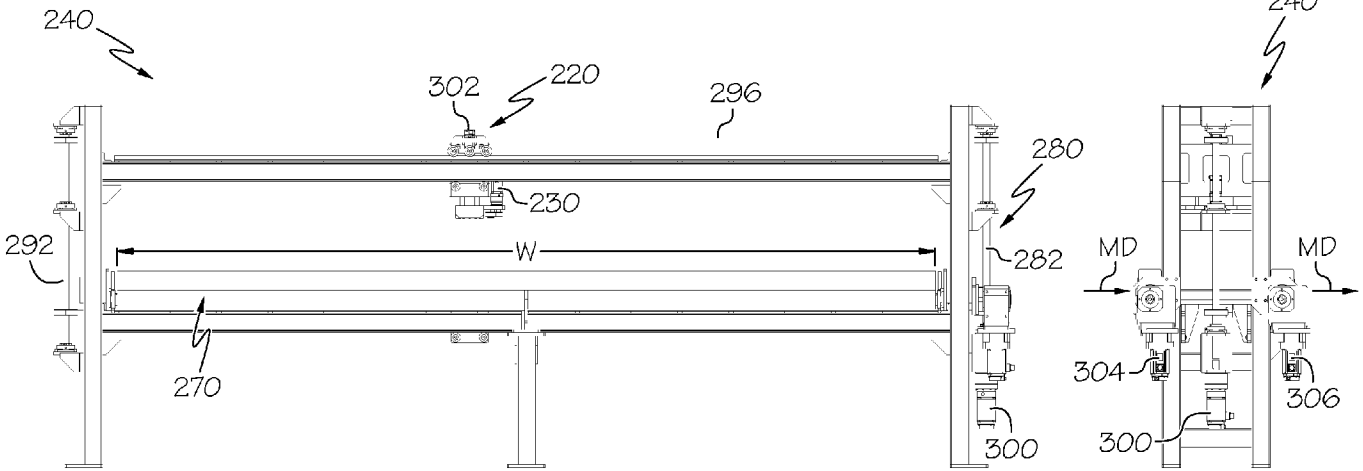
FIG. 16
FIG. 15

CROSS-TUFTING MACHINE AND PROCESS FOR CARPET MANUFACTURING

CROSS-REFERENCE TO RELATED APPLICATION

This application claims the priority benefit of U.S. Provisional Patent Application Ser. No. 61/783,034 filed Mar. 14, 2013, the entirety of which is hereby incorporated herein by reference for all purposes.

TECHNICAL FIELD

The present invention relates generally to the field of carpet manufacturing, and more particularly to a machine and process for tufting a secondary pattern into pre-tufted carpet.

BACKGROUND

Machine tufting is used to manufacture carpet of many types. Tufting machines typically use a row of several hundred needles to insert row after row of tufts simultaneously into backing fabric, which is drawn continuously along a machine direction to form a basic uniform pile. The piles creating the basic pattern of the carpet along the machine direction can be in the form of cut pile, loop pile, cut loop pile, level cut loop pile, and others. Typically, pattern design elements of the basic carpet pattern repeat along the machine direction. Known tufting machines for manufacturing carpet are thus typically limited to producing a basic pattern along the machine direction, which limits the designs capable of production by known carpet manufacturing processes and equipment.

Thus it can be seen that needs exist for improved processes and equipment for manufacturing carpet. It is to the provision of improved processes and equipment for manufacturing carpet meeting these and other needs that the present invention is primarily directed.

SUMMARY

In example embodiments, the present invention provides a cross-tufting machine and process for carpet manufacturing, which enables the production of more diverse pattern designs than previously known methods and equipment. Such patterns may include a primary tuft and/or color pattern of a base carpet produced according to traditional machine direction tufting, and a secondary tuft and/or color pattern over-tufted onto the base carpet. An overhead rail-mounted over-tufting head includes a punch gun, tufting gun or the like movable transversely to the machine direction (i.e., in the cross-machine direction) for forming the secondary tuft and/or secondary color pattern in the carpet. The crosswise movement of the over-tufting head is automatically controlled in coordination with the machine direction advancement of the base carpet to produce the desired pattern elements.

In one aspect, the present invention relates to a cross-tufting machine for tufting a secondary pattern into pre-tufted unbacked carpet. The cross-tufting machine includes a sewing head and a tufting gun mounted to the sewing head. The tufting gun is generally in the form of a punch gun, an air tuft gun, or a tufting mending gun. Optionally, support and/or transport railing or structure is included for movably mounting the sewing head, and a support platform is included for supporting the pre-tufted carpet.

In another aspect, the invention relates to a cross-tufting machine for tufting a secondary pattern into pre-tufted base carpet being fed in a machine direction from a feed roll to a take-up roll. The cross-tufting machine includes a sewing head and a tufting gun. The tufting gun mounts to the sewing head and can be in the form of a punch gun, an air tuft gun, or a tufting mending gun. The tufting gun generally includes one or more needles wherein yarn is fed to the gun and through the one or more needles. The tufting gun can tuft the secondary pattern into the pre-tufted carpet at various pile heights in the form of cut pile or loop pile. The feed of the yarn fed to the gun and through the one or more needles is controlled by a servo motor to control the yarn feed speed and tension to vary the pile height and the form of pile. A support platform can be included for supporting the pre-tufted carpet. The support platform includes a channel where the one or more needles of the tufting gun push through when tufting the secondary patterns into the pre-tufted carpet. A support railing can be included for movably mounting the sewing head. At least one servo motor controls the movement of the sewing head movably mounted to the support railing wherein the sewing head can move in a direction generally transverse to the machine direction.

Movement of the sewing head in the transverse direction while the carpet remains stationary provides an overtufted secondary pattern in a cross-wise pattern relative to the machine direction. Movement of the sewing head in the transverse direction while the carpet moves stepwise in the machine direction provides an over-tufted or secondary pattern in a diagonal pattern relative to the machine direction. Movement of the sewing head in the transverse direction while the carpet moves back and forth in the machine direction provides a tufted secondary pattern in a cross-wise zigzag pattern relative to the machine direction. Optionally, the start/end of the secondary pattern can be positioned anywhere along a width of the carpet to define a partial width pattern. Various alternative tuft and/or color patterns can be produced by selective control of the cross-tufting head in coordination with machine-direction movement of the base carpet.

In still another aspect, the invention relates to a cross-tufting machine for over-tufting pre-tufted carpet moving in a machine direction. The cross-tufting machine includes an over-tufting sewing head movably mounted for movement transverse to the machine direction movement of the pre-tufted carpet. The over-tufting sewing head is movably mounted on a rail or other support/transport structure, and comprises for example a punch, air-tuft, or tufting mending gun.

In another aspect, the invention relates to a process of manufacturing carpet. The process includes providing an over-tufting apparatus movable generally transverse or cross-wise to the machine direction, providing carpet generally in the form of pre-tufted carpet, and moving the over-tufting apparatus transversely across the carpet as the carpet moves in the machine direction to stitch or tuft a secondary or over-tufted pattern onto the base carpet.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

BRIEF DESCRIPTION OF THE DRAWINGS

FIG. 15 is a side view of the framing structure of FIG. 14.

FIG. 16 is an end view of the framing structure of FIG. 14.

FIG. 17 is a top view of the framing structure of FIG. 14.

DETAILED DESCRIPTION OF EXAMPLE EMBODIMENTS

Figure 2:
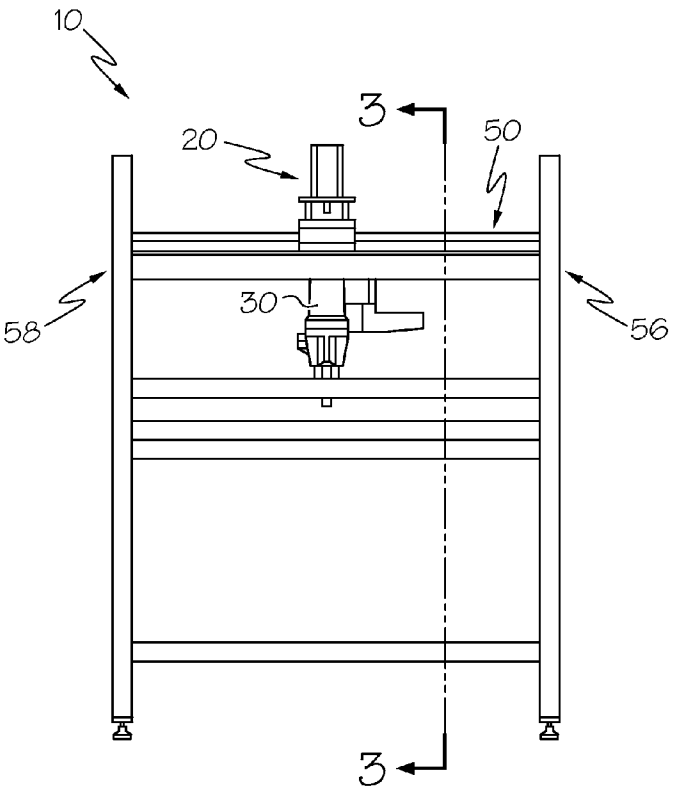
FIG. 2 is a side view of the cross-tufting machine of FIG. 1.
Figure 1:
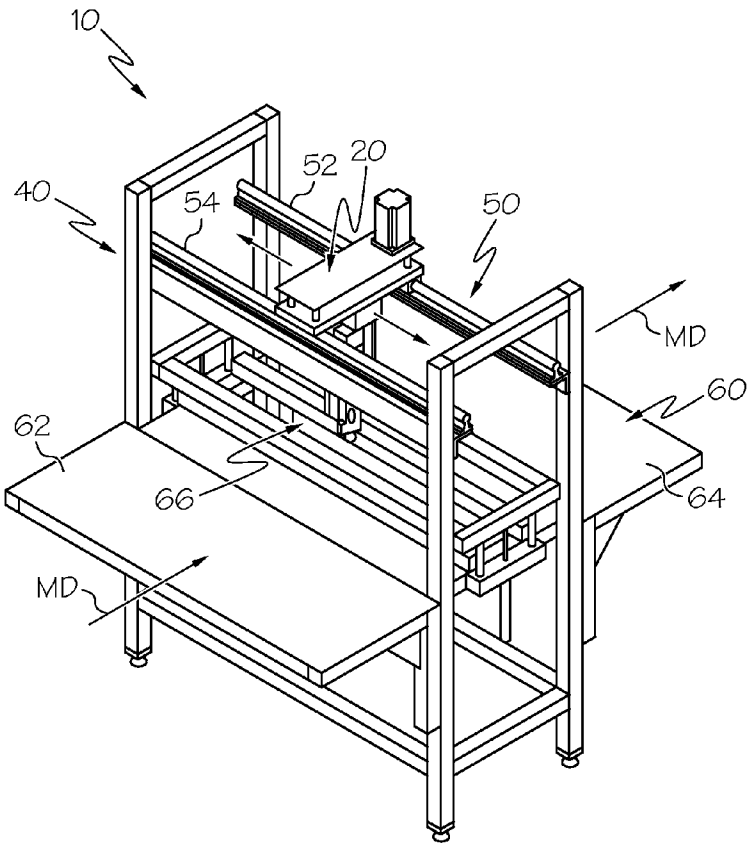
FIG. 1 is a perspective view of a cross-tufting machine according to an example embodiment of the present invention.
Figure 4:
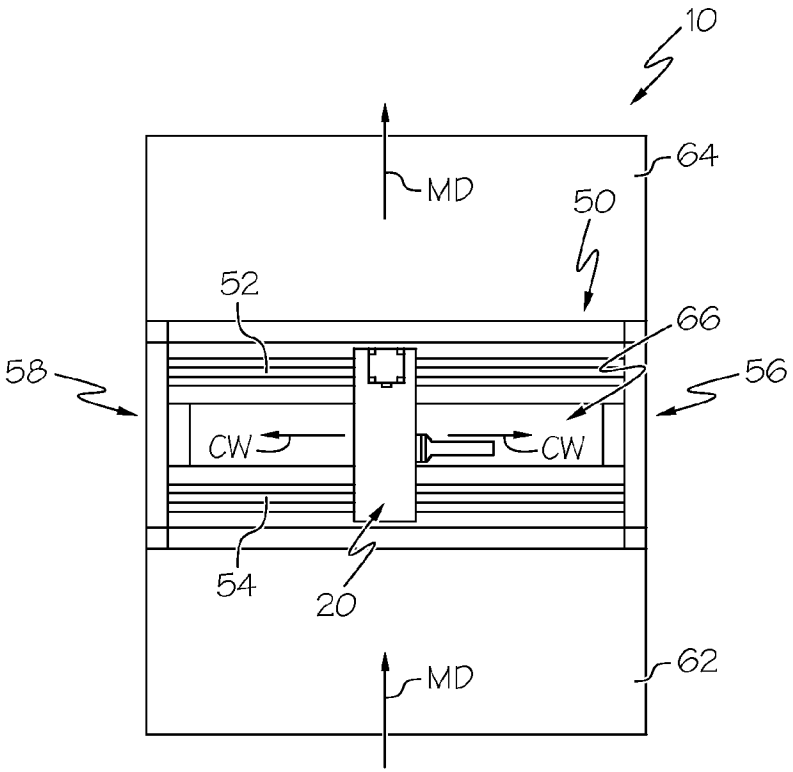
FIG. 4 is a top view of the cross-tufting machine of FIG. 1.
Figure 3:
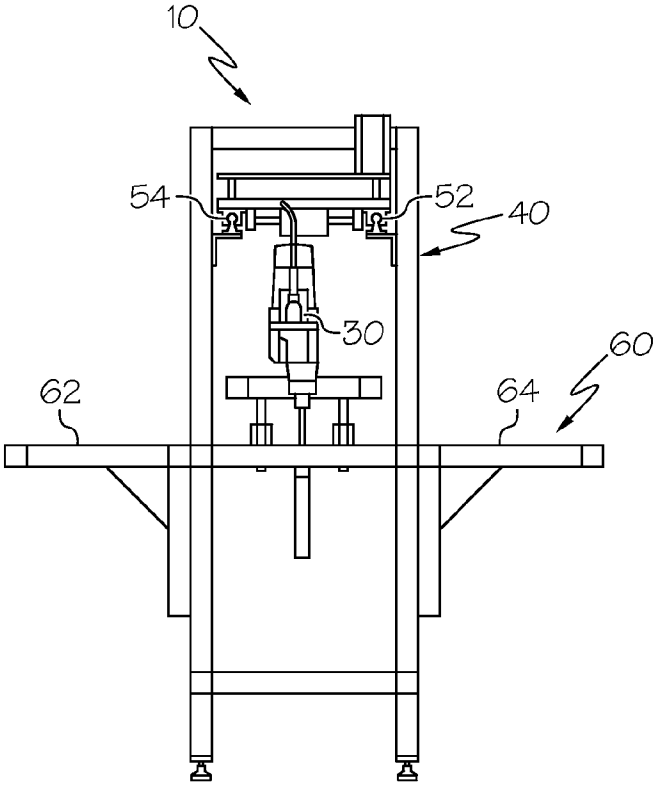
FIG. 3 is a sectional view of the cross-tufting machine of FIG. 2, taken along line 3-3.

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

With reference now to the drawing figures, wherein like reference numbers represent corresponding parts throughout the several views, FIGS. 1-4 show a railed over-tufting machine or cross-tufting machine 10 according to an example embodiment of the present invention. Generally described, the cross-tufting machine 10 can be operated to apply an over-tufted or secondary pattern onto base carpet defining a primary pattern (which primary pattern may comprise a pattern of varying tuft levels, varying colors, solid color, level tuft, and/or other known carpet format(s)), wherein additional design elements and new patterns are enabled by application of the secondary pattern. In example forms, the base carpet is preferably unbacked and comprises a primary backing that the yarn is stitched through.

The cross-tufting machine 10 generally comprises a carrier or sewing head 20 and a tufting gun 30. In example embodiments, the tufting gun 30 can be in the form of a Hoffman punch gun, an air tuft gun, or a tufting mending gun. Optionally, other types of tufting guns may be used as desired. While the depicted embodiment comprises a single tufting gun 30 mounted to a single carrier 20, optionally two or more tufting guns may be mounted to each carrier, and/or two or more carriers can be provided in similar fashion.

As depicted in FIGS. 1-4, the tufting gun 30 is mounted to the sewing head 20, and the sewing head 20 is mounted to a frame or framing structure 40. The framing structure 40 generally includes one or more transverse beam-like members to provide support to the sewing head 20 and the tufting gun 30, as well as providing support for the carpet that is to be tufted with the secondary pattern. In one form, the framing structure 40 comprises support railing 50 and a support platform 60. The support railing 50 allows for the sewing head to be movably mounted thereto wherein the sewing head can traverse back and forth in a cross-machine or cross-wise direction CW (see direction arrows). The support platform 60 is generally positioned below the support railing 50 and provides support for the carpet 100 that is to be provided with the tufted secondary pattern thereon. Generally, the carpet 100 moves on top of the support platform 60 in steps in a machine direction MD (see direction arrows) and the sewing head 20 moves back and forth in the cross-wise direction CW generally transverse or perpendicular to the machine direction, wherein the tufting gun forms tufts or a secondary pattern in the carpet 100 as it moves across the carpet. Yarn is generally fed to the gun 30 and through a needle mounted to an end of the gun 30. Optionally, the end of the gun 30 can comprise multiple parallel needles, for example, wherein each needle is provided with a separate strand of yarn. The strands of yarn can be of the same color or different colors.

In the depicted embodiment, the support railing 50 generally comprises a first rail 52 and a second rail 54. In one example embodiment, the first and second rail 52, 54 comprise linear rails generally extending from a first side 56 to a second side 58, and the sewing head 20 comprises linear bearings. As such, the sewing head 20 movably mounts to the support railing 50 for traversing along the first and second rails 52, 54 in the cross-wise direction CW between the first and second ends 56, 58. In one form, a chain, belt or other connecting member engages both the sewing head 20 and a servo motor. The servo motor provides for controlling both the speed of movement and position of the sewing head 20 in the cross-wise direction CW. Preferably, the tufting gun 30 having the yarn fed thereto and through the needle can tuft the secondary pattern into the carpet 100 at various pile heights, selectively controlled according to the desired secondary pattern. The pile can be in the form of cut pile, loop pile, or a combination thereof. Optionally, the feed of the yarn to the gun and through the needle is controlled by a servo motor, to control the yarn feed speed and tension to vary the pile height and form of the pile (e.g., cut pile, loop pile, or a combination).

Figure 5:
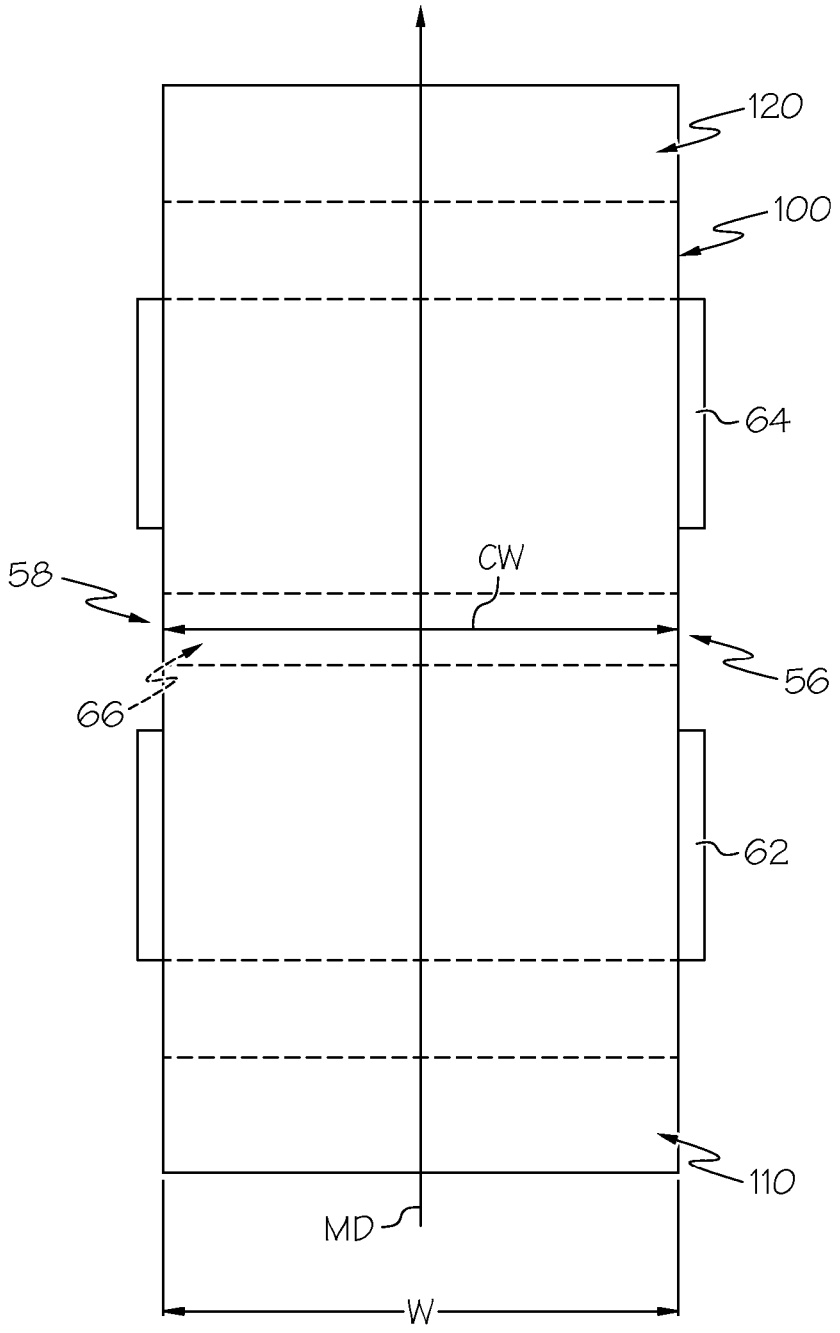
FIG. 5 is a top view of a portion of the cross-tufting machine of FIG. 4, showing carpet being supported thereon.

The support platform 60 generally comprises a first platform 62 and a second platform 64. A channel 66 is generally formed between the first and second platforms 62, 64 to extend below the tufting gun 30 along the cross-wise direction CW. The channel 66 preferably provides an open area wherein the needle can push through the carpet as the tufting gun forms the secondary pattern in the same. Thus, the channel 66 prevents the needle from bottoming out on the platform. Preferably, as depicted in FIG. 5, the carpet 100 (having a width W) is fed from a feed roll 110, over the support platform 60 and below the tufting gun 30, to a take-up roll 120. In one form, one or more servos mounted near the platform 60 provide movement to the carpet 100 as the tufting gun forms the secondary pattern. In another form, one or more servos mount to the take-up roll 120 or both the feed and take-up rolls 110, 120 to provide for feeding the carpet therethrough. The movement of the carpet can be a continuous movement (one speed or variable speeds) or a stepped movement, in both the machine direction and a direction generally opposite the machine direction. The various servos, motors, and other equipment are optionally automatically controlled to generate a specified pattern, for example by a programmable computerized control system or other automated control mechanism.

Figure 6:
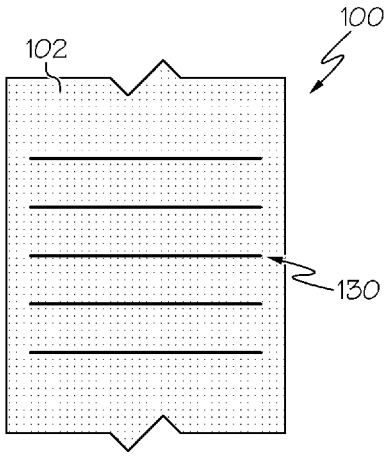
FIG. 6 shows a top view of a carpet portion having tufts formed therein according to another example embodiment of the present invention, wherein the tufts form a straight across or transverse secondary or over-tufted pattern.

FIGS. 6-9 show example secondary patterns that can be formed in the carpet 100 according to example embodiments of the present invention. In one example form, the carpet 100 is a pre-tufted unbacked carpet (e.g., comprising a primary backing that the yarn is stitched through). The carpet 100 preferably comprises a primary pattern 102 that extends along the machine direction, which may comprise a pattern of varying tuft levels, varying colors, solid color, level tuft, various pile forms (cut pile, loop pile, or a combination thereof), and/or other known carpet format(s). Similarly, the secondary patterns, as will be described below, can comprise a pattern of varying tuft levels, varying colors, solid color, level tuft, various pile forms (cut pile, loop pile, or a combination thereof), and/or other known carpet format(s). As shown in FIG. 6, the carpet 100 comprises a plurality of straight across patterns 130 that form the secondary patterns relative to the primary pattern 102 of the base carpet. For the straight across pattern 130, the carpet remains stationary wherein the sewing head 20 traverses along the cross-wise direction CW from the first side 56 to the second side 58. After completing one straight across pattern 130, the one or more servo motors provide movement to the carpet 100 in the machine direction MD for advancing to the next position where another straight across pattern 130 is to be tufted in the carpet 100. With the sewing head 20 now positioned at the second end 58, the sewing head 20 begins tufting the straight across pattern 130 in the cross-wise direction CW towards the first end 56. Optionally, after tufting the straight across pattern 130 with the sewing head 20 moving in the cross-wise direction CW from the first end 56 to the second end 58, the sewing head 20 returns to the first end 56 before tufting another straight across pattern 130.

Figure 7:
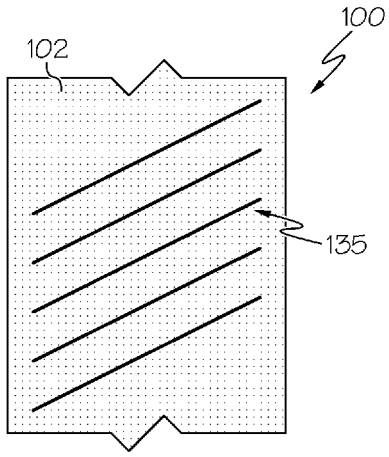
FIG. 7 shows a top view of a carpet portion having tufts formed therein according to another example embodiment of the present invention, wherein the tufts form a diagonal secondary or over-tufted pattern.

FIG. 7 shows the carpet 100 comprising a plurality of stepped cross-wise or diagonal patterns 135 according to another example embodiment of the present invention. The diagonal patterns 135 can be formed in the carpet 100 by moving both the sewing head 20 in the cross-wise direction CW and moving the carpet 100 in the machine direction MD. The carpet 100 generally moves stepwise at a desired speed while the sewing head 20 moves in the cross-wise direction CW at a desired speed. Preferably, the speeds of the movement of the carpet 100 and the sewing head 20 can be adjusted as desired to produce a desired diagonal pattern 135, for example to vary the angular offset of the secondary pattern relative to the machine or cross-wise direction(s). Optionally, the angle of the support railing 50 may be adjustable with respect to the machine direction to provide for a diagonal pattern 135, for example, wherein the carpet 100 can remain stationary.

Figure 8:
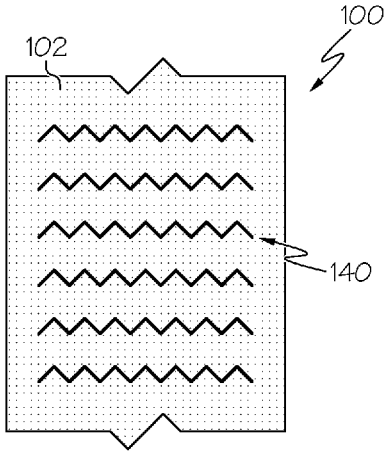
FIG. 8 shows a top view of a carpet portion having tufts formed therein according to another example embodiment of the present invention, wherein the tufts form a zigzag or continuous stepped secondary or over-tufted pattern.

FIG. 8 shows the carpet comprising a plurality of zigzag patterns 140 according to another example embodiment of the present invention. The zigzag patterns 140 can be formed in the carpet 100 by moving the sewing head 20 in the cross-wise direction CW and moving the carpet 100 back and forth in the machine direction MD. The carpet 100 generally moves back and forth in the machine direction MD at a desired speed while the sewing head 20 moves in the cross-wise direction CW at a desired speed. Preferably, the speeds of the movement of the carpet 100 and the sewing head 20 can be adjusted as desired to produce a zigzag pattern 140.

Figure 9:
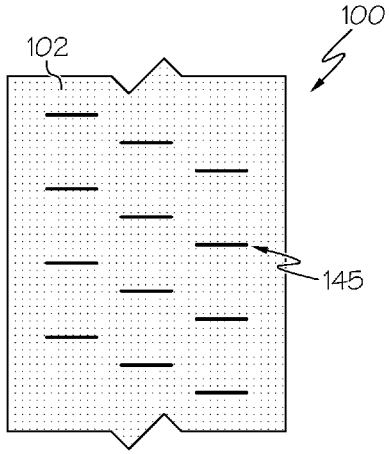
FIG. 9 shows a top view of a carpet portion having tufts formed therein according to another example embodiment of the present invention, wherein the tufts form a partial-width or intermittent stepped secondary or over-tufted pattern.
Figure 10:
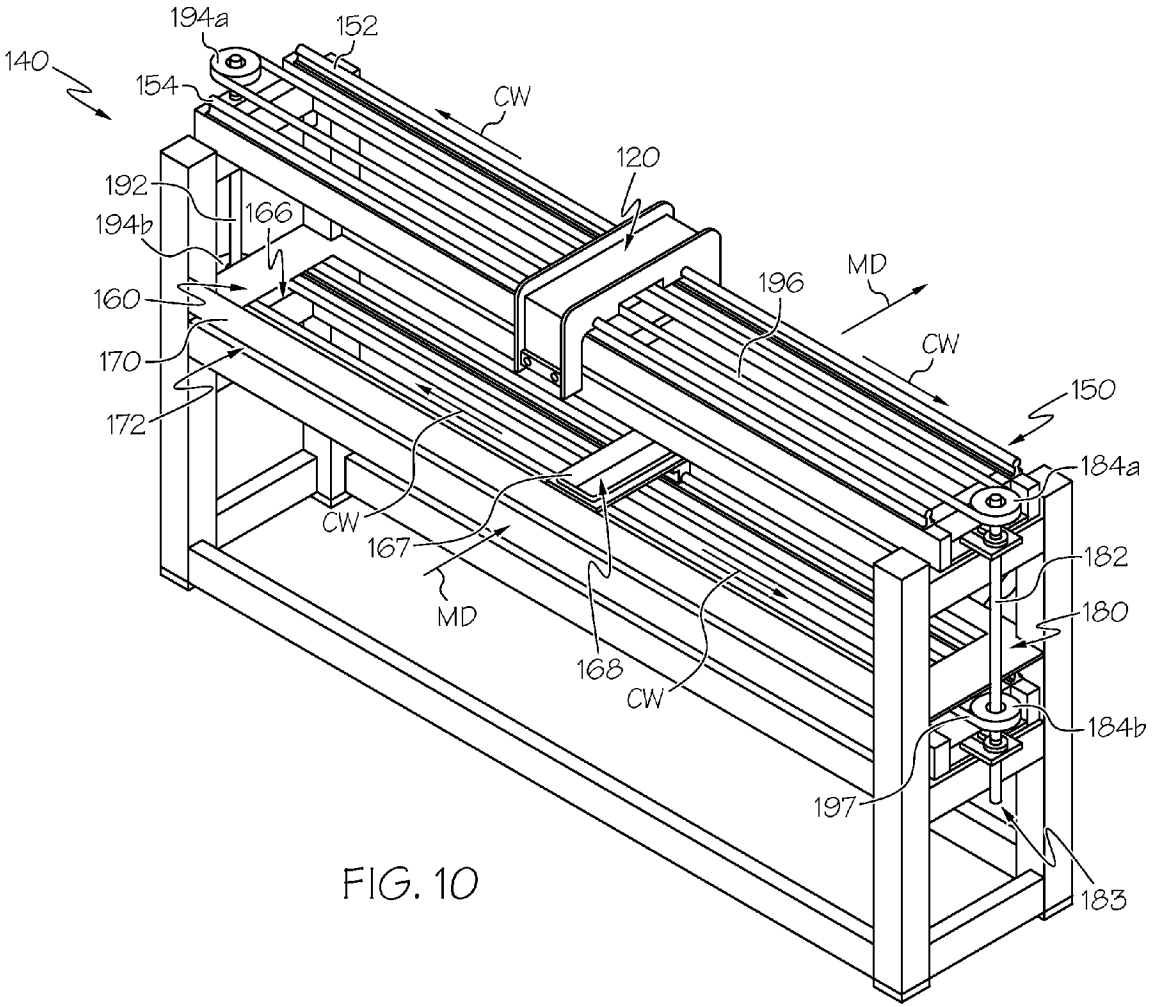
FIG. 10 is a perspective view of a framing support/transport structure for a cross-tufting machine according to another example embodiment of the present invention.
Figure 12:
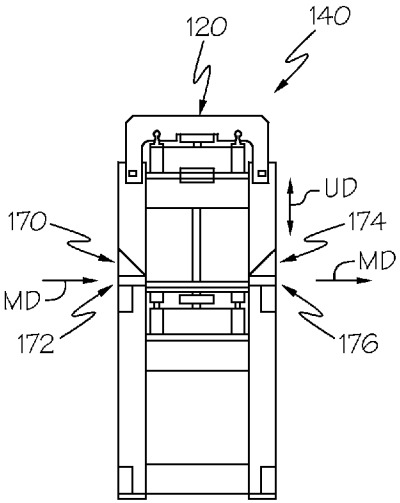
FIG. 12 is a sectional view of the framing structure of FIG. 11, taken along line 12-12.
Figure 13:
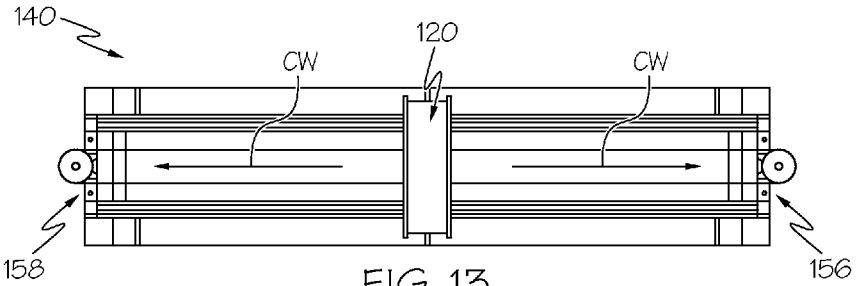
FIG. 13 is a top view of the framing structure of FIG. 10.
Figure 11:
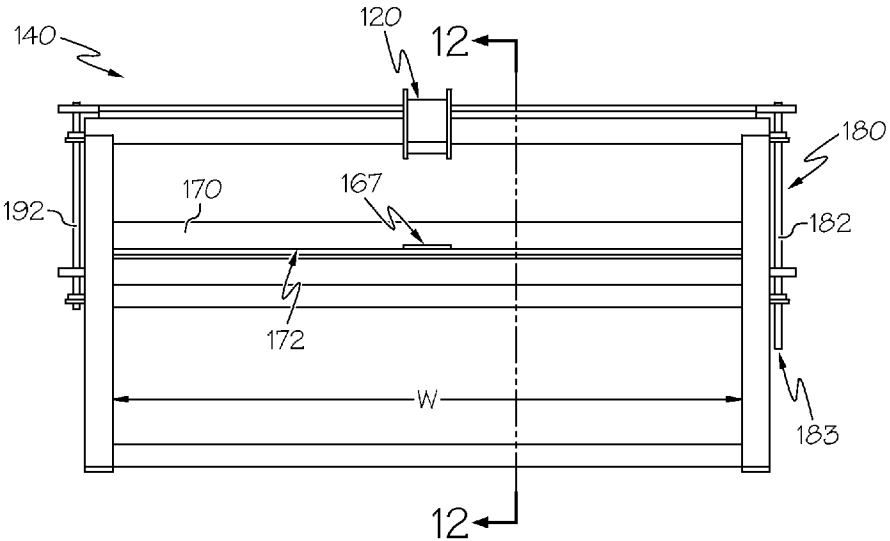
FIG. 11 is a side view of the framing structure of FIG. 10.

FIG. 9 shows the carpet comprising a plurality of partial width patterns 145 according to another example embodiment of the present invention. The partial width patterns 145 can be formed in the carped 100 by moving the sewing head in the cross-wise direction CW while the carpet 100 remains stationary. Preferably, the partial width patterns can start and end anywhere along the width W of the carpet. As depicted, the partial width pattern 145 generally comprises three offset straight across patterns. Optionally, other patterns, shapes, or other designs may be tufted into the carpet 100 as desired.

In example forms, the form and height of the pile of the primary pattern 102 and secondary pattern can be chosen as desired (e.g., same height, varying heights, cut pile, loop pile, combinations thereof). In one example form, the tufts of the primary pattern 102 are in the form of loop pile and the tufts of the secondary pattern are in the form of loop pile. In another form, the tufts of the primary pattern 102 are in the form of loop pile and the tufts of the secondary pattern are in the form of cut pile. In another form, the tufts of the primary pattern 102 are in the form of cut pile and the tufts of the secondary pattern are in the form of loop pile. In yet another form, the tufts of the primary pattern 102 are in the form of cut pile and the tufts of the secondary pattern are in the form of cut pile. In alternate embodiments, the primary pattern may be woven or constructed otherwise whereby the tufted secondary pattern can be provided thereon.

In additional example embodiments, the cross-tufting machine 10 or components of the cross-tufting machine 10 may be modified as desired. In one example embodiment, the sewing head 20 may pivot about an axis generally transverse to an axis defined by the movement of the sewing head 20 in the cross-wise direction CW. In another example embodiment, the sewing head 20 (and support railing 50) can be configured to allow the head 20 to move in the machine direction MD, or in both the cross-wise direction CW and the machine direction MD. In yet another example embodiment, the cross-tufting machine 10 can comprise multiple sewing heads 20. For example, the sewing heads 20 (each having a tufting gun 30 mounted thereto) may be spaced along an axis generally defined by the machine direction MD to increase the through-put by tufting multiple secondary pattern rows in the carpet 100 at once. As such, yarn is fed to each gun 20 and through the needle of each gun 20. Each sewing head 20 can comprise yarn of the same color or may comprise yarn of different colors. Optionally, in the case where multiple sewing heads are used, the sewing heads may pivot about an axis generally transverse to an axis defined by the movement of the sewing head 20 in the cross-wise direction CW. The over-tufting gun may stitch in a first transverse direction only, following a stitch-and-return pattern; or may stitch in both directions in a back-and-forth pattern.

FIGS. 10-13 show a frame or framing structure 140 according to another example embodiment of the present invention. The framing structure 140 generally includes a plurality of beam-like members to provide support to the sewing head 120 and the tufting gun 130, as well as provide support for the carpet that is to be tufted with the secondary pattern. As depicted, the framing structure 140 comprises support railing 150, a support platform 160, and a drive assembly 180. The support railing 150 extends transversely to the machine direction and allows for the sewing head 120 to be movably mounted thereto wherein the drive assembly 180 provides movement to the sewing head 120 to traverse back and forth in a cross-wise direction CW. The support platform 160 is generally positioned below the support railing 150 and provides support for the carpet 100 that is to be provided thereon with the tufted secondary pattern. Generally, the carpet 100 moves on top of the support platform 160 in stepwise increments or continuously in a machine direction MD, and the sewing head 120 moves back and forth in the cross-wise direction CW wherein the tufting gun forms tufts or a secondary pattern in the carpet 100. In one form, a needle plate or movable lower table 167 is movably mounted within a channel 166 formed in the support platform 160 to follow the sewing head. Generally, the movable lower table 167 comprises a channel 168 formed therein for allowing the needle(s) of the tufting gun to pass therethrough when tufting the secondary pattern. As such, the movable lower table 167 preferably remains vertically aligned with the sewing head 120 such that the carpet will be supported by the moveable lower table 167 as the tufting gun tufts the secondary pattern.

The transport or drive assembly 180 preferably provides movement to the sewing head 120 and the needle plate 167 along the crosswise direction CW. In general, the drive assembly 180 comprises first and second drive spindles 182, 192 that are rotatably mounted near the first and second ends 156, 158 of the support railing 150 wherein pulleys 184*a*, 184*b*, 194*a*, 194*b* engage belts 196, 197 extending therebetween. As such, a motor, servo, or other drive mechanism engages a free end 183 of the first spindle 182 to cause movement to the sewing head 120 and the needle plate 167. Generally, portions of the belts 196, 197 mount to portions of the sewing head 120 and the needle plate 167 such that rotation of the free end 183 causes movement to the belts 196, 197, and further causes the sewing head 120 and the needle plate 167 (vertically aligned) to traverse along the crosswise direction CW. Optionally, other drive mechanisms can be used to controllably move the sewing head 120 and the needle plate 167 along the crosswise direction CW.

Optionally, to provide support to the carpet that is moving in the machine direction MD, clamp-like members or contact grippers 170, 174 can be movably mounted above the support platform 160. For example, the clamp-like members 170, 174 (generally extending along a width substantially similar to the width W of the carpet) movably mount generally above the support platform 160 wherein elongate gaps or channels 172, 176 are formed to provide for the carpet moving therethrough. In use, the clamp-like members 170, 174 generally traverse or actuate in reciprocating fashion in an up-and-down direction UD to secure the carpet to the support platform 160 so that the tufting can be performed. Generally, the clamp-like members 170, 174 are air actuated wherein an upward movement in the up-and-down direction UD is provided to release the carpet when the carpet is to be moved along the machine direction MD, and wherein a downward movement in the up-and-down direction UD is provided to engage the carpet when the carpet is to be supported or secured to the support platform 160, for example, when the carpet is to be provided with the tuft secondary pattern by the tufting gun.

Figure 14:
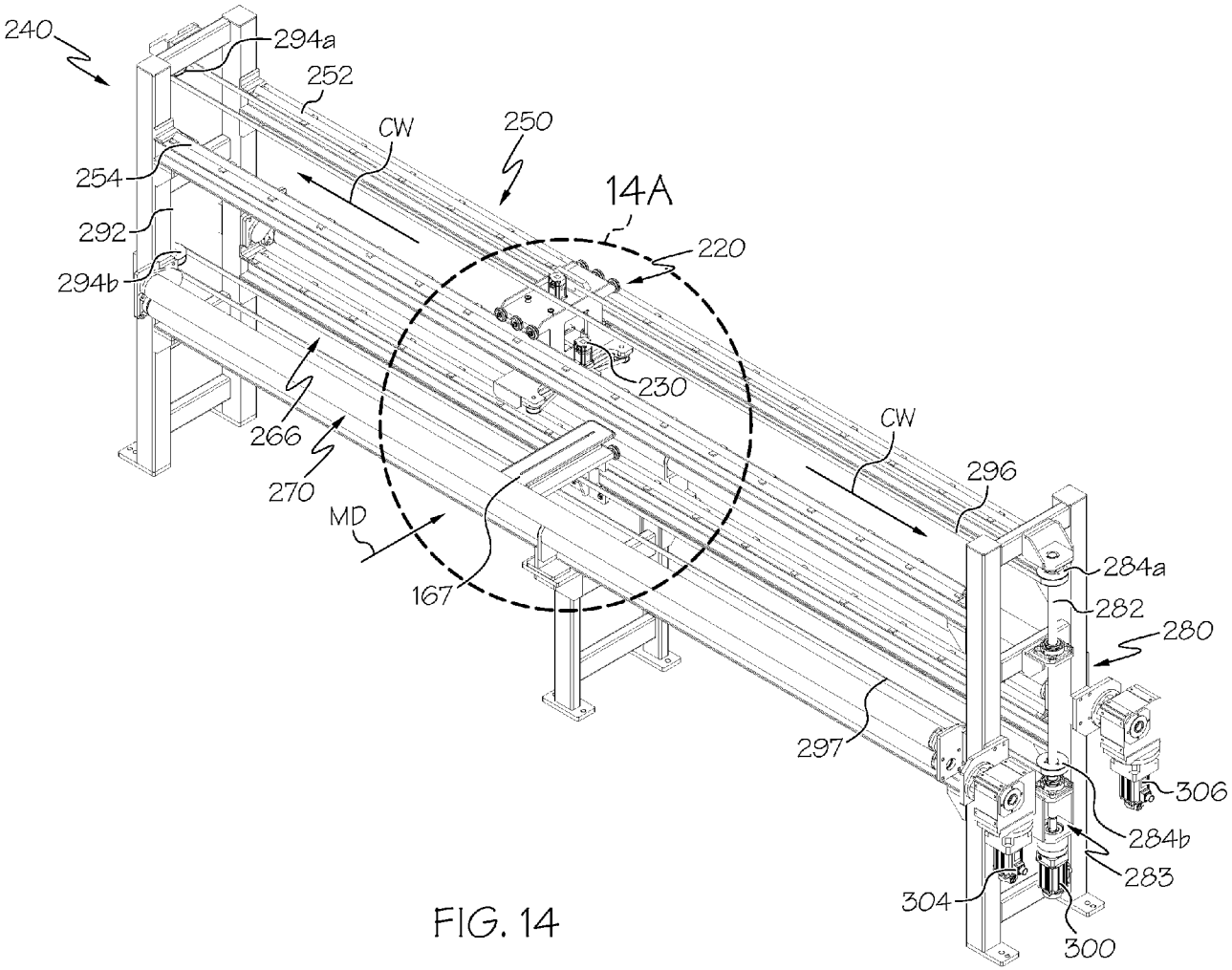
FIG. 14 is a perspective view of a framing structure for a cross-tufting machine according to another example embodiment of the present invention.

FIGS. 14-17A show a frame or framing structure 240 according to another example embodiment of the present invention. Generally, the framing structure 240 is constructed and configured similarly to the framing structure 140 as described above. As depicted in FIG. 14, the framing structure 240 generally includes a plurality of beam-like members to provide support to the sewing head 220 and the tufting gun 230, as well as provide support for the carpet that is to be tufted with the secondary pattern. In example forms, the framing structure 240 comprises support railing 250 and a drive assembly 280 including at least one motor or servo 300 for moving the sewing head 220 along the support railing 250. The support railing 250 generally extends transversely to the machine direction MD and allows for the sewing head 220 to be movably mounted thereto such that motor 300 of the drive assembly 280 provides movement to the sewing head 220 to traverse back and forth in a cross-wise direction CW. Preferably, the drive assembly 280 operates and functions similarly to the drive assembly 180 of the framing structure 140. In one form, as similarly described above, a needle plate or movable lower table 267 is movably mounted within a channel 266 that is defined between two generally elongate roll-feed supports 270, 274. Generally, the movable lower table 267 comprises a channel 268 formed therein for allowing the needle(s) of the tufting gun to pass therethrough when tufting the secondary pattern. As such, the movable lower table 267 preferably remains vertically aligned with the sewing head 220 such that the carpet will be supported by the moveable lower table 267 as the tufting gun tufts the secondary pattern. Preferably, the roll-feed supports 270, 274, as will be described in greater detail below, provide movement and support for the carpet that is to be provided thereon with the tufted secondary pattern.

Figure 14A:
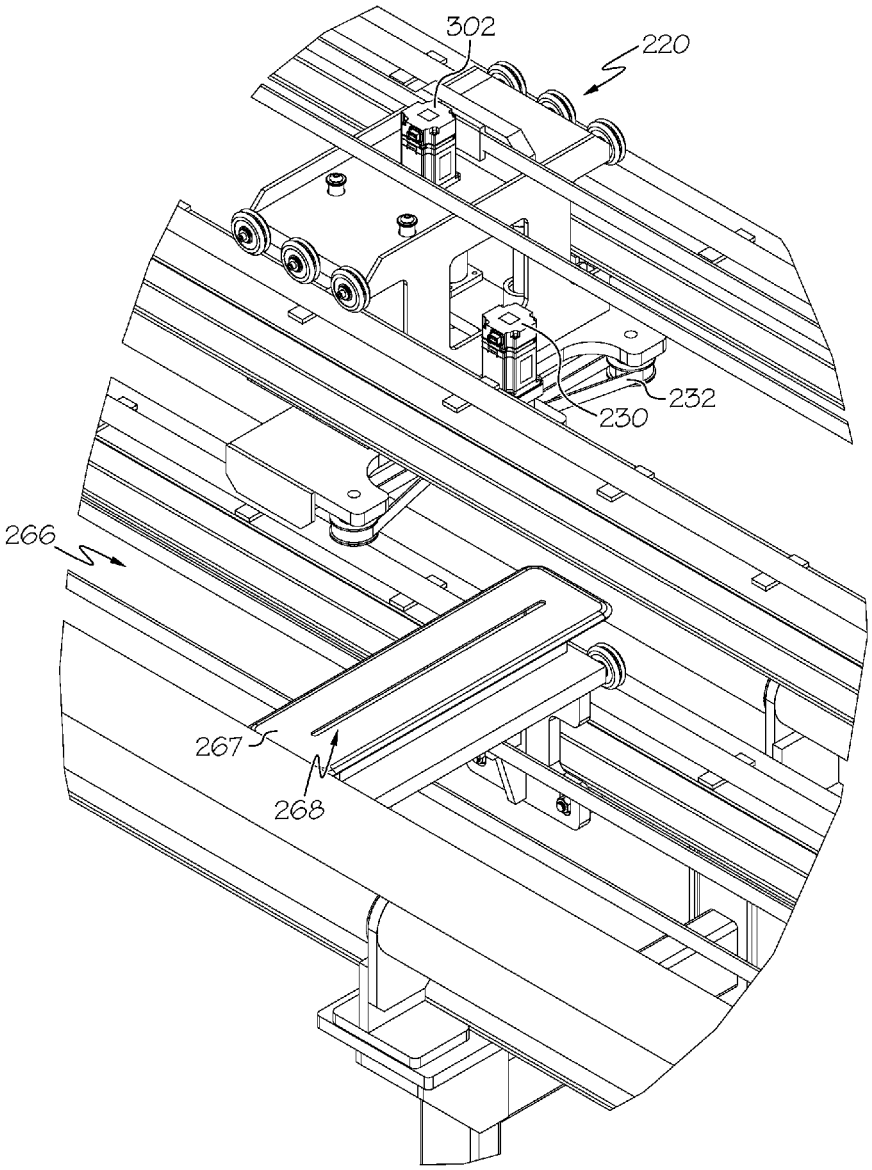
FIG. 14A is a detailed view of a portion of the framing structure shown in FIG. 14.

FIG. 14A shows greater detail of the sewing head 220. In example forms, the tufting gun 230 can move along three separate axes. For example, the tufting gun 230 can move in the cross-wise direction CW by movement of the sewing head 220 moving along the support railing 250 (e.g., the first and second rails 252, 254). Similarly, the tufting gun 230 is movable in a direction generally axial with the machine direction MD by providing a motor or servo 302 mounted to the sewing head 220 and linked to a belt 232. The belt 232 is fastened to a portion of the tufting gun 230 such that movement of the belt 232 causes movement of the tufting gun 230 in a direction generally axial with the machine direction MD. Thus, the needle of the tufting gun 230 is generally capable of moving along the channel 268 of the lower table 267 when the motor 302 provides movement to the belt 232, in turn causing the tufting gun 230 to move in a direction generally axial with the machine direction MD. An additional motor or servo or other drive mechanism can be provided such that the sewing head 220 and/or the tufting gun 230 can move in an axial direction generally transverse the machine direction MD and the cross-wise direction CW (e.g., vertically up and down). Thus, the tufting gun can move up and down to engage or disengage the carpet that is to be tufted with the secondary pattern. Further, the tufting gun 230 can rotate or pivot about the axis that is transverse the machine direction MD and the cross-wise direction CW, for example wherein the tufting gun is pivotal about the generally vertical axis.

Figure 17A:
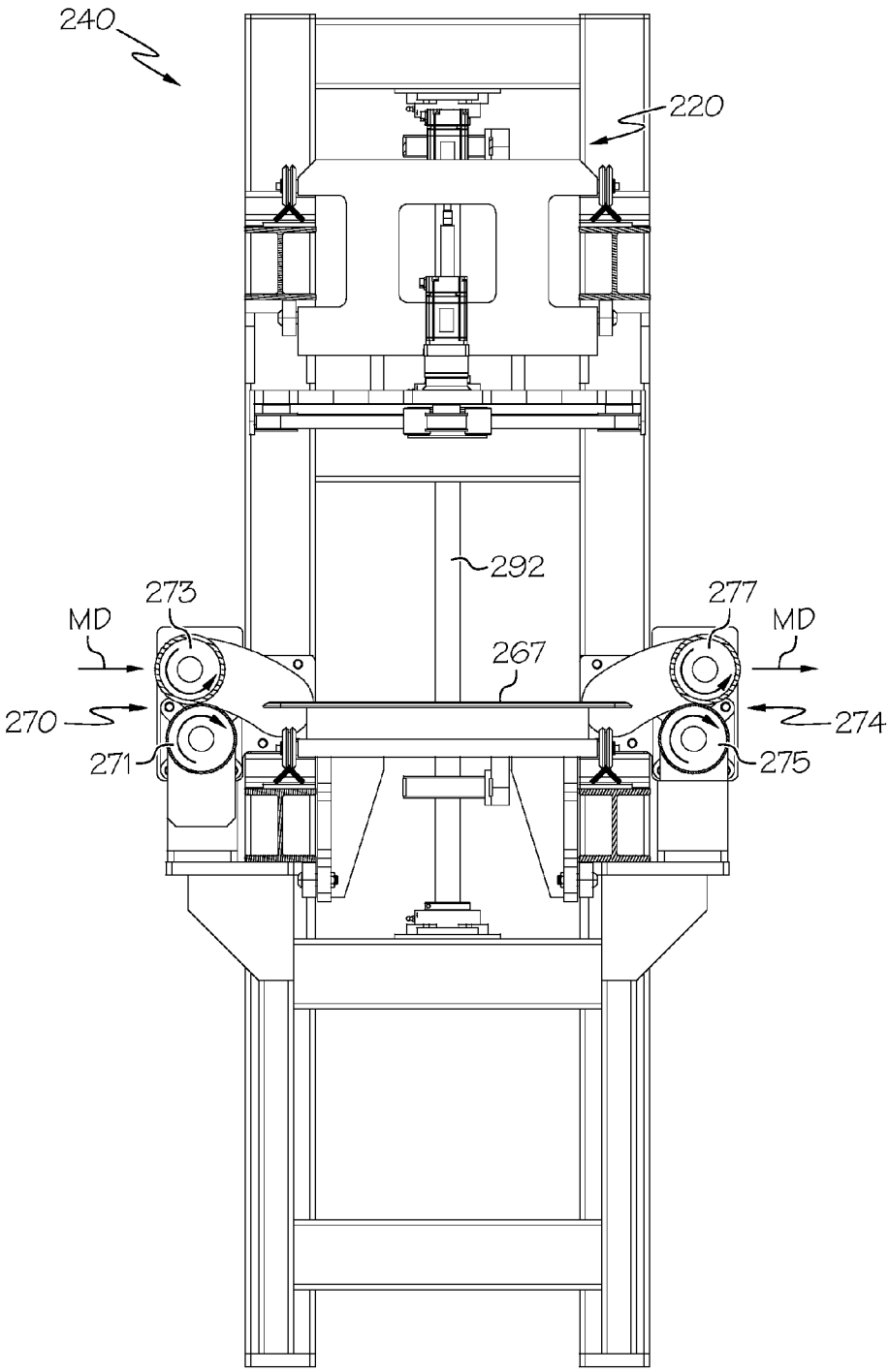
FIG. 17A is a sectional view of the framing structure of FIG. 17, taken along line 17A-17A.

FIGS. 15-17A show greater details of the roll-feed supports 270, 274. As depicted, the roll-feed supports 270, 274 preferably extend along the length of the framing structure 240 and comprise a width W substantially similar to the width W of the carpet. In example forms, each roll-feed support 270, 274 comprise a pair of cylinders that are rotatably mounted to provide movement to the carpet in the machine direction MD. For example, as depicted in FIG. 17A, the first roll-feed support 270 comprises a first and second roll member 271, 273 and the second roll-feed support 274 comprises a first and second roll member 275, 277. In one example form, the first roll members 271, 275 are preferably linked to respective motors or servos 304, 306 and the second roll members 273, 277 are generally biased against the first roll members 271, 275 to remain in contact therewith. The carpet is preferably inserted between the first and second roll member 271, 273 of the first roll-feed support 270, pulled across the channel 266 (resting atop the needle plate 267), and inserted between the first and second roll member 275, 277 of the second roll-feed support 274. Thus, with the second roll members 273, 277 being biased against their respective first roll member 271, 275, rotation (clockwise) of the first roll members 217, 275 (driven by the motors or servos 304, 306) causes the carpet to move along the machine direction MD atop the needle plate 267 as desired. As similarly described above, the roll-feed supports 270, 274 are capable of moving the carpet in stepwise increments or continuously in the machine direction, or in a direction generally opposite the machine direction MD.

In example forms, a vision system can be incorporated with the cross-tufting machine to provide for precise alignment of the carpet with the tufting gun, and/or to monitor the quality of the tufted secondary pattern. Generally, the vision system can comprise one or more cameras, sensors, lasers, stitches, or other sensing systems that are capable of interacting or communicating with the carpet and the machine. In one form, the vision system comprises an alignment feature whereby patterns in the carpet can be recognized such that the over tufting or the tufted secondary pattern is formed on a particular portion of the carpet (e.g., offset, adjacent or directly atop a particular pattern). In some forms, the vision system is linked to a programmable computerized control system or other automated control mechanism that comprises an outline of the carpet pattern in addition to where the tufted secondary patterns are to be applied. The same vision system that is used to align the tufting gun with the carpet and/or a separate vision system can be provided to monitor the quality of the tufted secondary patterns that are formed in the carpet. Preferably, the vision system includes software defining specified parameters that the tufted secondary pattern must meet in order to meet quality standards. In the case that the tufted secondary pattern does not meet the quality standards, the control system optionally further comprises an alarm or control system to key the machine to stop, or the portion of the tufted secondary pattern identified as not meeting the specified quality standard can be marked for review or inspection.

In other example embodiments, the present invention relates to a process of manufacturing carpet. The process generally includes providing an over-tufting machine comprising a sewing head having a tufting gun mounted thereto, providing a base carpet, the base carpet preferably in the form of pre-tufted unbacked carpet, and moving the sewing head transversely across the base carpet as the carpet moves in steps and/or continuously in the machine direction MD to stitch or tuft a secondary pattern in the cross-wise direction CW. Optionally, the operation of the over-tufting machine is computer controlled or mechanically controlled in an automated fashion, allowing an operator to specify a selected over-tufted pattern for application to the base carpet. The control system optionally varies the movement of the carpet in the machine direction, and/or the movement of the over-tufting machine according to a specified pattern to define the secondary pattern.

In yet another example embodiment, the present invention relates to a method of over-tufting a previously tufted carpet including providing the previously tufted carpet, providing an air gun or a sewing gun, and tufting through the previously tufted carpet by hand or with a machine. Thus, the air gun or sewing gun can be manually operated by a user (e.g., held in the hands of the user) and/or the gun can be mounted to the machine wherein the gun can provide a secondary or over-tufted pattern on the previously tufted carpet. In some forms, when it is desired to manually provide the over-tufted pattern on the previously tufted carpet, a mechanical device or clamp-like holding apparatus can be provided to hold or contain the carpet while the user forms the over-tufted pattern on the previously tufted carpet.

In still further aspects, the invention relates to a carpet product produced by the manufacturing systems and/or processes described herein, the carpet comprising a base carpet having a secondary pattern over-tufted thereon, for example according to any of the above-described embodiments.

While the invention has been described with reference to preferred and example embodiments, it will be understood by those skilled in the art that a variety of modifications, additions and deletions are within the scope of the invention, as defined by the following claims.

What is claimed is:

1. A cross-tufting machine for tufting a secondary pattern into pre-tufted carpet being fed in a machine direction from a feed roll to a take-up roll, the cross-tufting machine comprising:

a sewing head; and a tufting gun mounted to the sewing head, the tufting gun comprising one or more needles, wherein yarn is fed to the gun and through the one or more needles, and wherein the tufting gun can over-tuft the secondary pattern into the pre-tufted carpet at one or more selected pile heights.

2. The cross-tufting machine of claim 1, wherein the tufting gun comprises a punch gun, an air tuft gun, or a tufting mending gun.

3. The cross-tufting machine of claim 1, wherein the over-tufting comprises a cut pile or a loop pile.

4. The cross-tufting machine of claim 3, wherein the feed of the yarn fed to the gun and through the one or more needles is controlled by a servo motor to control the yarn feed speed and tension to vary the pile height and the form of pile.

5. The cross-tufting machine of claim 1, further comprising a support platform for supporting the pre-tufted carpet.

6. The cross-tufting machine of claim 5, wherein the support platform comprises a channel where the one or more needles of the tufting gun push through when tufting the secondary pattern into the pre-tufted carpet.

7. The cross-tufting machine of claim 6, further comprising a movable lower table movably mounted within the channel.

8. The cross-tufting machine of claim 7, wherein the movable lower table comprises a channel formed therein for allowing the one or more needles of the tufting gun to pass therethrough when tufting the secondary pattern.

9. The cross-tufting machine of claim 7, wherein the movable lower table remains vertically aligned with the sewing head as the carpet traverses along the crosswise direction.

10. The cross-tufting machine of claim 1, further comprising a support railing for movably mounting the sewing head thereto.

11. The cross-tufting machine of claim 10, wherein at least one servo motor controls the movement of the sewing head movably mounted to the support railing.

12. The cross-tufting machine of claim 10, wherein the sewing head can pivot.

13. The cross-tufting machine of claim 10, wherein the sewing head can move in a direction generally transverse to the machine direction.

14. The cross-tufting machine of claim 13, wherein movement of the sewing head in the transverse direction while the carpet remains stationary provides a tufted secondary pattern in a cross-wise pattern relative to the machine direction.

15. The cross-tufting machine of claim 13, wherein movement of the sewing head in the transverse direction while the carpet moves stepwise in the machine direction provides a tufted secondary pattern in a diagonal pattern relative to the machine direction.

16. The cross-tufting machine of claim 13, wherein movement of the sewing head in the transverse direction while the carpet moves back and forth in the machine direction provides a tufted secondary pattern in a cross-wise zigzag pattern relative to the machine direction.

17. The cross-tufting machine of claim 10, wherein the sewing head is movable in the machine direction.

18. The cross-tufting machine of claim 10, wherein the sewing head is movable in a diagonal direction having combined movement in both the transverse direction and the machine direction.

19. The cross-tufting machine of claim 10, wherein the tufting gun is movable relative to the sewing head in a vertical direction, the vertical direction being transverse the machine direction and the transverse direction.

20. The cross-tufting machine of claim 1, further comprising multiple sewing heads wherein each sewing head comprises a tufting gun mounted thereto, and wherein yarn is fed to each gun and through the one or more needles of each gun.

21. The cross-tufting machine of claim 20, wherein the sewing heads can pivot.

22. The cross-tufting machine of claim 20, wherein the multiple sewing heads are spaced along an axis defined by the machine direction to increase through-put by tufting multiple secondary patterns simultaneously.

23. A cross-tufting machine for over-tufting pre-tufted carpet, the pre-tufted carpet moving in a machine direction, the cross-tufting machine comprising:

an over-tufting sewing head movably mounted for movement transverse to the machine direction movement of the pre-tufted carpet.

24. The cross-tufting machine of claim 23, wherein the over-tufting sewing head is movably mounted on a rail.

25. The cross-tufting machine of claim 23, wherein the over-tufting sewing head comprises a punch, tuft, or mending gun.

26. The cross-tufting machine of claim 23, wherein the punch, tuft, or mending gun comprises one or more tufting needles.

27. The cross-tufting machine of claim 26, wherein yarn is fed to the gun and through the one or more needles.

28. The cross-tufting machine of claim 23, further comprising a support for supporting the pre-tufted carpet moving in the machine direction.

29. The cross-tufting machine of claim 28, further comprising a channel wherein the one or more needles having yarn feeding therethrough can push through the pre-tufted carpet to form a tufted secondary pattern thereon.

30. The cross-tufting machine of claim 23, wherein the movement of the over-tufting sewing head is controlled by servo motors.

31. The cross-tufting machine of claim 23, wherein the movement of the pre-tufted carpet moving in the machine direction is controlled by at least one servo motor.

32. The cross-tufting machine of claim 31, further comprising one or more roll-feed supports linked to the at least one servo motor.

33. The cross-tufting machine of claim 31, wherein the pre-tufted carpet is fed from a feed roll to a take-up roll, wherein the over-tufting takes place therebetween.

34. A process of manufacturing carpet comprising:

moving a pre-tufted carpet in a machine direction; and over-tufting a secondary pattern in a direction generally cross-wise to the machine direction.

35. An over-tufted carpet produced according to the process of claim 34.

36. An over-tufted carpet comprising a pre-tufted base carpet defining a primary pattern, a width, and a lengthwise direction, and an over-tufted secondary pattern extending generally across at least a portion of the width of the pre-tufted base carpet and generally transverse to the lengthwise direction.

37. The over-tufted carpet of claim 36, wherein the primary pattern is selected from a solid color and tuft pattern, a varying color pattern and/or a varying tuft pattern, and wherein said primary pattern repeats in the lengthwise direction.

38. The over-tufted carpet of claim 36, wherein the secondary pattern is selected from a contrasting color and/or a contrasting tuft pattern relative to the primary pattern.

39. The over-tufted carpet of claim 36, wherein the base carpet is an unbacked carpet.

40. An over-tufted carpet prepared by a process comprising the steps of:

providing an over-tufting machine, the over tufting machine comprising a sewing head having a tufting gun mounted thereto;

providing carpet, the carpet generally in the form of pre-tufted carpet comprising a primary backing; and moving the sewing head generally transversely across the carpet as the carpet moves in a machine direction to over-tuft a secondary pattern through the primary backing.

41. A method of over-tufting a pattern into previously tufted carpet, said method comprising:

providing a piece of pre-tufted carpet;

over-tufting a pattern into the piece of pre-tufted carpet by hand or by machine.

* * * * *